US009546469B2

(12) United States Patent
Van Hooft et al.

(10) Patent No.: US 9,546,469 B2
(45) Date of Patent: Jan. 17, 2017

(54) DEVICE TO ACTUATE A FLUID CONNECTOR CONTAMINATION COVER

(75) Inventors: Cornelius Antonius Maria Van Hooft, Ah Helvoirt (NL); Dirk Jacobus Luyendijk, Re Heeswijk-Dinther (NL); Holger Jongebloed, Wilhelmshaven (DE)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 414 days.

(21) Appl. No.: 14/128,088

(22) PCT Filed: Jun. 26, 2012

(86) PCT No.: PCT/EP2012/062384

§ 371 (c)(1),
(2), (4) Date: Dec. 20, 2013

(87) PCT Pub. No.: WO2013/000926

PCT Pub. Date: Jan. 3, 2013

(65) Prior Publication Data

US 2014/0123635 A1 May 8, 2014

(30) Foreign Application Priority Data

Jun. 28, 2011 (EP) ..... 11171792

(51) Int. Cl.
*E02F 9/22* (2006.01)
*E02F 3/36* (2006.01)

(52) U.S. Cl.
CPC ..... *E02F 9/2278* (2013.01); *E02F 3/3654* (2013.01); *E02F 3/3663* (2013.01); *E02F 9/226* (2013.01); *E02F 9/2275* (2013.01)

(58) Field of Classification Search
CPC ..... E02F 3/3604; E02F 3/3654; E02F 3/3663; E02F 3/3622; E02F 9/226; E02F 9/2275
See application file for complete search history.

(56) References Cited

U.S. PATENT DOCUMENTS 2,131,815 A * 10/1938 Nilson ..... B66F 1/08 254/108
4,251,993 A * 2/1981 Vancil ..... B63C 3/06 60/537

(Continued)

FOREIGN PATENT DOCUMENTS

CN 200978433 11/2007
CN 102041825 5/2011

(Continued)

OTHER PUBLICATIONS

European Search Report, Sep. 14, 2012.
International Search Report, Sep. 14, 2012.

*Primary Examiner* — F. Daniel Lopez
*Assistant Examiner* — Richard Drake

(57) ABSTRACT

A device to actuate a contamination cover on a machine bracket, the device comprising a master cylinder positioned on the machine bracket; a first slave cylinder positioned on the machine bracket and connected to the contamination cover; and a closed master-slave circuit connecting the master cylinder to the slave cylinder wherein the actuation of the master cylinder drives the slave cylinder for the transition of the contamination cover from a close to an open position.

20 Claims, 6 Drawing Sheets

(56) References Cited

U.S. PATENT DOCUMENTS

| | | | | | |
|---|---|---|---|---|---|
| 4,371,004 | A * | 2/1983 | Sysolin | E02F 3/3654 | 137/614.04 |
| 5,082,389 | A | 1/1992 | Balemi | | |
| 5,533,336 | A * | 7/1996 | Kiat | B30B 15/0052 | 100/270 |
| 6,324,844 | B1 * | 12/2001 | Gautier | B60T 7/04 | 60/533 |
| 6,899,509 | B1 * | 5/2005 | Mailleux | E02F 3/3622 | 37/468 |
| 8,919,692 | B2 * | 12/2014 | Halcom | B64C 27/50 | 244/17.11 |
| 2010/0018195 | A1 * | 1/2010 | Stanger | E02F 9/2217 | 60/414 |

FOREIGN PATENT DOCUMENTS

| | | | | | |
|---|---|---|---|---|---|
| DE | 19751292 | C1 | | 2/1999 | |
| DE | 10041755 | A1 | | 3/2002 | |
| DE | 202007001232 | U1 | | 4/2007 | |
| DE | 102008014769 | A1 | | 9/2009 | |
| EP | 2426271 | A2 | | 3/2012 | |
| JP | 201065386 | | | 3/2010 | |
| WO | WO 99/27194 | | | 6/1999 | |
| WO | WO 2010141132 | A2 | * | 12/2010 | B64C 27/50 |
| WO | WO 2013/000926 | | | 1/2013 | |

* cited by examiner

DEVICE TO ACTUATE A FLUID CONNECTOR CONTAMINATION COVER

TECHNICAL FIELD

This disclosure relates to a device and a method for control of coupling components that couple a worktool to a machine, particularly to a method and a device for control of contamination covers of fluid connectors. This disclosure also relates to a coupling arrangement for coupling a work tool to a machine.

BACKGROUND

Worktools, such as shears, grabs, or buckets may be coupled with host machines, such as excavators, to perform work operations like cutting, grabbing or excavating. The worktools may be coupled to a boom or stick mechanism of the host machine via a fixed connection or a quick release connection.

A quick release connection may allow for a relatively easy exchange of the worktool whereby the operator connects or changes a worktool without leaving the cab. The machine mounting bracket is arranged to slide into the worktool mounting bracket, when the worktool is positioned on the ground. After aligning the mounting bracket of the worktool and the mounting bracket of the machine, a locking device may be moved into a locked position to lock the worktool to the machine.

When connecting the work tool to the machine, the hydraulic hoses of the machine and work tool pressure fluid circuits may be connected for driving the work tool. Automatic hydraulic hose connection systems are known which may be activated by the operator from the cab for connection of the hydraulic hoses. Such systems may often be dependent on the connection of the work tool to the machine. Hydraulic hose couplers may be provided and arranged so that during connection of the work tool to the machine the hose couplers are also automatically connected. When the work tool mounting bracket is connected to the machine mounting bracket, the hose couplers may be contemporaneously connected.

The worktool or machine unused during a specific operation may be subject to external elements such as moisture and dust or other contaminants which may settle on the fluid connectors of the hydraulic lines. Such contamination may damage the fluid connectors of the worktool or the machine during a coupling procedure or may result in impeding the coupling of the machine mounting bracket and the worktool mounting bracket.

WO199927194 discloses a device for protecting connection elements on construction equipment from grime, dust and water. The connection elements may serve to connect lines for liquid and gaseous mediums or for electric cables. A covering arrangement may protect the connection elements. The covering arrangement may comprise a tubular and movable envelope provided with openings which cover or expose the connection elements through rotation of the envelope around the connection elements. The envelope may be provided on the worktool bracket or the machine bracket and may be rotated by actuation of a lever connected thereto.

The present disclosure is directed, at least in part, to improving or overcoming one or more aspects of the prior art system.

SUMMARY

In a first aspect, the present disclosure provides a device to actuate a contamination cover on a machine bracket, the device comprising a master cylinder positioned on the machine bracket; a first slave cylinder positioned on the machine bracket and connected to the contamination cover; and a closed master-slave circuit connecting the master cylinder to the slave cylinder wherein the actuation of the master cylinder drives the slave cylinder for the transition of the contamination cover from a closed to an open position.

In a second aspect, the present disclosure provides a coupling arrangement for fluid coupling a work tool to a machine, the coupling arrangement comprising: at least one coupler assembly slideably mounted for coupling a machine fluid circuit and a work tool fluid circuit at a connect position; an actuation fluid circuit arranged to actuate the at least one coupler assembly from a disconnect position to the connect position; a sensor to detect presence of the work tool for activation of the actuation fluid circuit; and a device to actuate a contamination cover on a machine bracket, the device comprises: a master cylinder positioned on the machine bracket; a first slave cylinder positioned on the machine bracket and connected to the contamination cover; and a master-slave circuit connecting the master cylinder to the slave cylinder wherein the actuation of the master cylinder drives the slave cylinder for the transition of the contamination cover from a closed to an open position.

Other features and advantages of the present disclosure will be apparent from the following description of various embodiments, when read together with the accompanying drawings.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to a device 10 to control the movement of a contamination cover provided on a machine bracket to prevent contamination of fluid connector disposed on the machine bracket. This disclosure also relates to a coupling arrangement 110 for coupling a machine hydraulic fluid circuit to a work tool hydraulic fluid circuit.

Figure 1:
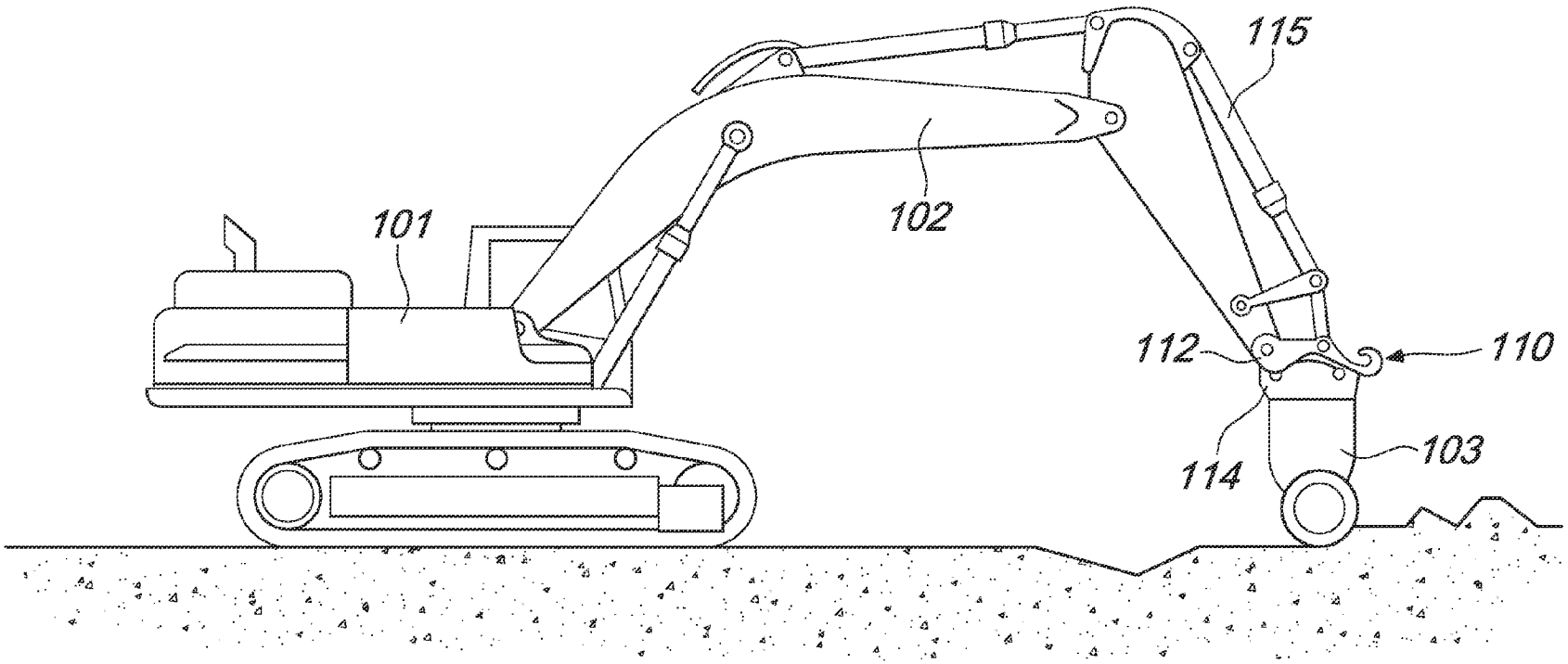
FIG. 1 is a side view of a machine and a work tool provided with a device according to the present disclosure.

FIG. 1 illustrates a host machine 101, as a hydraulic excavator, which may be provided with a hydraulic boom mechanism for driving a boom 102 and a work tool 103. In this description, a boom 102 may be understood as comprising a hydraulic stick mechanism, or similar mechanisms.

Machine 101 may be a mobile machine such as for example an excavator, a back hoe, a digger, a loader, a knuckle boom loader, a harvester or a forest machine.

The work tool 103 may be coupled to the machine 101 through the boom 102. In the embodiment shown, the work tool 103 may comprise a rotary cutter. In other embodiments, work tools 103 may for example include buckets, grapples, hammers and pulverizers.

The work tool 103 may comprise a frame which carries multiple exchangeable and/or interchangeable tools.

The work tool 103 may comprise a work tool bracket 114 and the machine 101 may comprise a machine bracket 112. The work tool bracket 114 and machine bracket 112 may each comprise fluid connectors. The machine bracket 112 may be a quick coupler.

The machine 101 may be provided with a device 10 and a coupling arrangement 110. The device 10 may actuate a contamination cover provided on the machine bracket 112. The coupling arrangement 110 may allow for fluid coupling between the machine bracket 112 and the work tool bracket 114.

A pressurized fluid assembly 115 may extend along the boom 102 for moving the boom 102 and the work tool 103. The pressurized fluid assembly 115 may comprise multiple hydraulic circuits, including a machine fluid circuit and an actuation fluid circuit 9.

The work tool 103 may comprise a work tool fluid circuit for the hydraulic control thereof. The machine fluid circuit may control fluid flow and pressurisation of the fluid through the work tool fluid circuit.

The machine fluid circuit may be arranged to drive the boom 102 and to pivot the boom parts with respect to each other. The machine fluid circuit may be arranged to move the work tool 103. For example, the machine fluid circuit may be arranged to pivot and/or rotate the work tool 103 or may be arranged to drive moving parts in the work tool 103, such as rotary parts.

The actuation fluid circuit 9 may be arranged to enable fluid coupling between the machine fluid circuit and the work tool fluid circuit.

Figure 2:
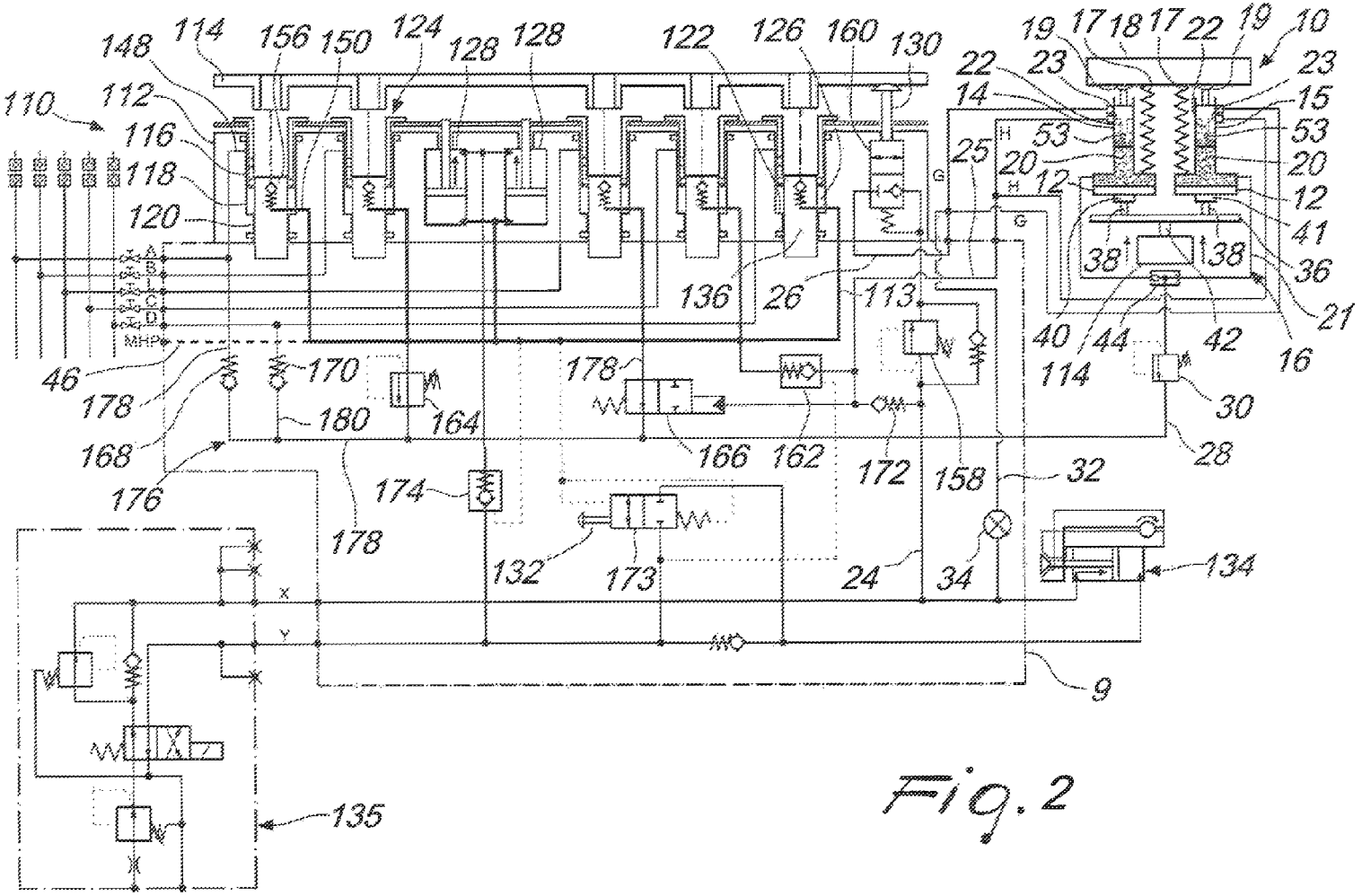
FIG. 2 is a schematic representation of an embodiment of the device connected to a coupling arrangement according to the present disclosure.

FIG. 2 illustrates a schematic representation of an embodiment of a device 10 for actuation of a contamination cover 18. The device 10 may control the transition of the contamination cover 18 between an open position and a closed position. The contamination cover 18 may be provided on the machine bracket 112.

The contamination cover 18 may be moveable between an open position and a closed position. In the closed position the contamination cover 18 may extend over fluid connectors disposed in the machine bracket 112. The contamination cover 18 may shield fluid connectors from contaminants, such as dust, dirt or small rocks. At the open position of the contamination cover 18 the fluid connectors may be uncovered and may be available for connection to corresponding fluid connectors that may be disposed in the work tool bracket 114.

The contamination cover 18 may be made of a resilient material. The contamination cover 18 may be able to withstand being subjected to a deformation.

The device 10 may comprise a master cylinder 12, a slave cylinder 14 and a master-slave circuit 16.

The master cylinder 12 may be positioned on the machine bracket 112. The master cylinder 12 may be a hydraulic cylinder comprising a cylinder barrel wherein a piston may be connected to a master piston rod 40.

The master cylinder 12 may be mounted on the machine bracket 112 by suitable means. The master cylinder 12 may be disposed in any suitable position on the machine bracket 112.

The slave cylinder 14 may be positioned on the machine bracket 112. The slave cylinder 14 may be mounted on the machine bracket 112 by suitable means. The slave cylinder 14 may be disposed in any suitable position on the machine bracket 112.

The slave cylinder 14 may be a hydraulic cylinder comprising a cylinder barrel wherein a piston may be connected to a slave piston rod 19. The slave cylinder 14 may be connected to the contamination cover 18. The slave cylinder 14 may be connected to the contamination cover 18 through the slave piston rod 19. The movement of the slave piston rod 19 may effect the transition of the contamination cover 18 from the closed position to the open position.

The slave piston rod 19 of the slave cylinder 14 may be connected to the contamination cover 18 through a suitable mechanical connection. The slave piston rod 19 may be connected to a suitable connection point on the contamination cover 18. In an embodiment, the slave piston rod 19 may be connected to a center region of the contamination cover 18.

The device 10 may comprise a biasing element 17. The biasing element 17 may be connected at one end to the slave cylinder 14 and at the opposite end to the contamination cover 18.

The biasing element 17 may be compressed when the contamination cover 18 is moved from the closed position to the open position. The compressed biasing element 17 may drive the transition of the contamination cover 18 from the open position to the closed position.

In an embodiment, the biasing element 17 may be a coil spring.

The master-slave circuit 16 may hydraulically connect the master cylinder 12 to the slave cylinder 14. The master cylinder 12 may be hydraulically connected to the slave cylinder 14 such that the actuation of the master cylinder 12 may in turn actuate the slave cylinder 14 to effect the transition of the contamination cover 18 from the closed position to the open position.

The master-slave circuit 16 may be a closed circuit. The master-slave circuit 16 may operate independently of the actuation fluid circuit 9 and the machine fluid circuit.

The master-slave circuit 16 may comprise a fluid line to connect the master cylinder 12 to the slave cylinder 14 to move an oil volume 20 between the master cylinder 12 and the slave cylinder 14. The master-slave circuit 16 may comprise fluid lines that connect the piston side chamber of the master cylinder 12 to the piston side chamber of the slave cylinder 14 to move the oil volume 20 between the master cylinders 12 and the slave cylinder 14.

In an embodiment, the device 10 may further comprise a second slave cylinder 15 which is hydraulically connected to the master cylinder 12. The second slave cylinder 15 may be positioned on the machine bracket 112. The second slave cylinder 15 may be a hydraulic cylinder comprising a cylinder barrel wherein a piston may be connected to a slave piston rod 19.

The second slave cylinder 15 may be connected to the contamination cover 18. The slave piston rod 19 may be connected to the contamination cover 18. The movement of the slave piston rod 19 of the second slave cylinder 15 in conjunction with the slave piston rod 19 of the first slave cylinder 14 may effect the transition of the contamination cover 18 from the open position to the closed position.

The slave piston rods 19 of the first and second slave cylinders 14, 15 may be connected to the contamination cover 18 through suitable mechanical connections. The slave piston rods 19 may be connected to suitable connection points on the contamination cover 18. In an embodiment, the slave piston rods 19 may be connected to opposite sides of the contamination cover 18.

The device 10 may comprise a biasing element 17 connected at one end to the second slave cylinder 15 and at the opposite end to the contamination cover 18.

In an embodiment, the master-slave circuit 16 may hydraulically connect the master cylinder 12 to the first slave cylinder 14 and the second slave cylinder 15. The master cylinder 12 may be hydraulically connected to the first and second slave cylinders 14, 15 so that actuation of the master cylinder 12 may in turn actuate the slave cylinders 14, 15 to effect the transition of the contamination cover 18 from the close position to the open position.

The master-slave circuit 16 may comprise fluid lines to connect the master cylinder 12 to first slave cylinder 14 and the second slave cylinder 15 to move an oil volume 20 between the master cylinder 12 and the first and second slave cylinders 14, 15. The master-slave circuit 16 may comprise fluid lines that connect the piston side chamber of the master cylinder 12 to the piston side chamber of the first and second slave cylinders 14, 15 to move the oil volume 20 between the master cylinder 12 and the slave cylinders 14, 15.

Figure 3:
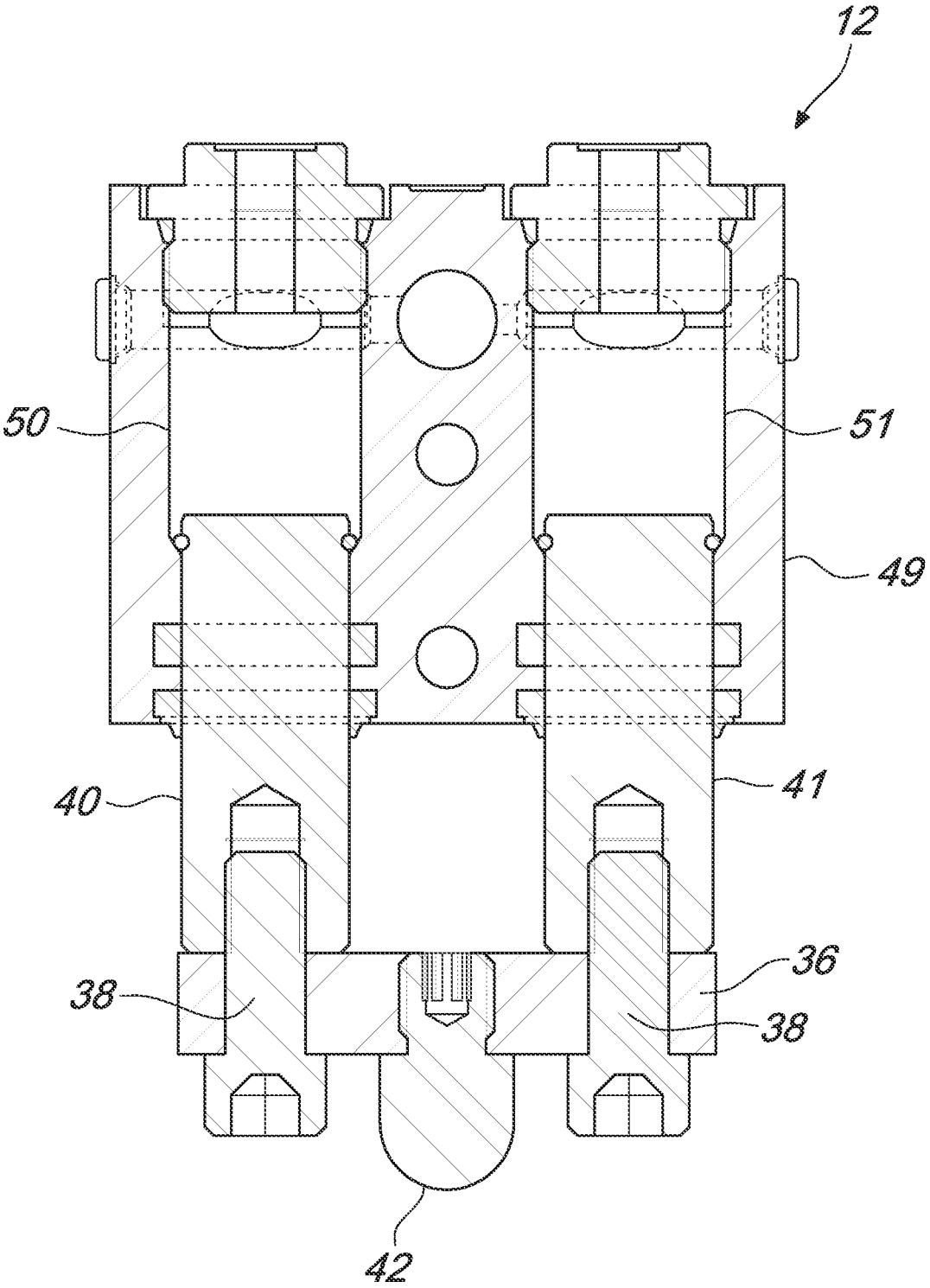
FIG. 3 is a cross-sectional view of a master cylinder having a first cylinder barrel and a second cylinder barrel according to the present disclosure.

The master-slave circuit 16 may further comprise a fluid line 21 connecting the first slave cylinder 14 to the second slave cylinder 15. The master-slave circuit 16 may further comprise fluid line 21 to connect the piston side chamber of the first slave cylinder 14 to the piston side chamber of the second slave cylinder 15. In an embodiment, with reference to FIG. 3 illustrating a cross-section of the master cylinder 12, the master cylinder 12 may comprise a hydraulic cylinder body 49 having a first master cylinder barrel 50 and a second master cylinder barrel 51. A first master piston rod 40 may be disposed in the first master cylinder barrel 50. A second piston rod 41 may be disposed in the second master cylinder barrel 51.

The master-slave circuit 16 may hydraulically connect the first master cylinder barrel 50 to the first slave cylinder 14 and the second master cylinder barrel 51 to the second slave cylinder 15. The master cylinder 12 may be hydraulically connected through the first and second master cylinder barrels 50, 51 to the first and second slave cylinders 14, 15 so that actuation of the master cylinder 12 may in turn actuate the slave cylinders 14, 15 to effect the transition of the contamination cover 18 from the closed position to the open position.

The master-slave circuit 16 may comprise fluid lines to connect the first master cylinder barrel 50 to the first slave cylinder 14 and the second master cylinder barrel 51 to the second slave cylinder 15 to move an oil volume 20 between the master cylinder 12 and the first and second slave cylinders 14, 15. The master-slave circuit 16 may comprise fluid lines that connect the piston side chambers of the first and second master cylinder barrels 50, 51 to the piston side chambers of the first and second slave cylinders 14, 15 to move the oil volume 20 between the master cylinder 12 and the slave cylinders 14, 15.

The first master piston rod 40 and the second master piston rod 41 may be coupled through a link member 36. The link member 36 may effect synchronised movement of the first master piston rod 40 and the second piston rod 41. The link member 36 may push the first master piston rod 40 and the second master piston rod 41 simultaneously into the respective master cylinder barrels 50, 51.

The synchronised retraction of first master piston rod 40 and the second master piston rod 41 may displace an equal oil volume 20 from the first master cylinder barrel 50 and the second master cylinder 51 barrel as the first and second master piston rods 40, 41 move simultaneously in the respective master cylinder barrels 50, 51.

The displaced oil volumes 20 from the first master cylinder barrel 50 and the second master cylinder barrel 51 may be respectively transmitted to the first and second slave cylinders 14, 15. The displaced oil volumes 20 may effect synchronised extraction of the slave piston rods 19 to move the contamination cover 18.

The transition of the contamination cover 18 may be effected in a smooth motion with the two slave piston rods 19 connected to the contamination cover 18 and driven by the synchronised retraction of first master piston rod 40 and the second piston rod 41.

The link member 36 may be a rigid body. The link member 36 may be a plate extending between the first master piston rod 40 and the second piston rod 41.

In an embodiment, the link member 36 may comprise arms 38. The arms 38 may extend transversely from the link member 36. The link member 36 may be disposed in the device 10 such that each arm 38 may respectively contact the first master piston rod 40 and the second piston rod 41.

Each arm 38 may be mechanically connected to the first master piston rod 40 and the second piston rod 41. In an embodiment, each arm 38 may be threaded through the link member 36.

In an embodiment, each arm 38 may be disposed on the link member 36 such that the center thereof may be equidistant to the arms 38.

During coupling of the machine bracket 112 and the work tool bracket 114, the link member 36 may abut against the work tool bracket 114. In an embodiment, the link member 36 may abut against the fluid connectors disposed in the work tool bracket 114. The side of the link member 36 opposite to the side of the arms 38 may abut against the work tool bracket 114 or the fluid connectors disposed therein.

In an embodiment, the link member 36 may comprise an interference element 42. The interference element 42 may abut against the work tool bracket 114. In an embodiment, the interference element 42 may abut against the fluid connectors disposed in the work tool bracket 114.

The interference element 42 may be positioned on the side of the link member 36 opposite to the side on which the arms 38 may be positioned. The interference element 42 may be positioned at the center of the link member 36. The interference element 42 may be disposed on the link member 36 at a position equidistant from the arms 38.

The interference element 42 provides a single point of abutment on the link member 36 to abut the work tool bracket 114. The interference element 42 provides a single point on abutment of the link member 36 to abut the fluid connectors disposed in the work tool bracket 114.

The abutting engagement of the link member 36 to the work tool bracket 114 or the fluid connectors disposed therein may be coupled to the movement of the first master piston rod 40 and the second piston rod 41. The abutting engagement of the link member 36 to the work tool bracket 114 or the fluid connectors disposed therein may effect the retraction of the first master piston rod 40 and the second piston rod 41 into the respective master cylinder barrels 50, 51.

The abutment of the link member 36 to the work tool bracket 114 or the fluid connectors disposed therein may effect the retraction of the first master piston rod 40 and the second piston rod 41 simultaneously into the respective master cylinder barrels 50, 51 to drive the synchronised movement of the slave piston rods 19 to move the contamination cover 18.

In an embodiment, the first and second master piston rods 40, 41 of the master cylinder 12 may each preferably be displaceable up to 20 mm. In an embodiment, the slave cylinders 14, 15 may each preferably be a slave piston rod 19 that is displaceable up of 100 mm.

With reference to FIG. 2, the device 10 may be hydraulically connected to the actuation fluid circuit 9. The first slave cylinder 14 and/or the second slave cylinder 15 may be connected to the actuation fluid circuit 9. Hydraulic fluid may flow from the actuation fluid circuit 9 to the first slave cylinder 14 and/or the second slave cylinder 15 of device 10 through line X, line 24, line 26, and lines G. Hydraulic fluid may flow from the first slave cylinder 14 and/or the second slave cylinder 15 of device 10 to the actuation fluid circuit 9 through line H and line 25. In an embodiment, a further line H may connect second slave cylinder 15 to line 25. Hydraulic fluid may flow from the first slave cylinder 14 and the second slave cylinder 15 of device 10 to the actuation fluid circuit 9 through lines H and line 25.

In an embodiment, the actuation fluid circuit 9 may comprise lines X, 24, 26, G, H and 25.

The device 10 may comprise a coupling switch 23 in the first slave cylinder 14 and/or the second slave cylinder 15.

In an embodiment, the coupling switch 23 may be provided in the slave piston rod 19 of the first slave cylinder 14 and/or the second slave cylinder 15. The coupling switch 23 may connect lines G and H to enable flow of fluid through the actuation fluid circuit 9. The coupling switch 23 may be in fluid communication simultaneously with lines G and H when the slave piston rod 19 moves the contamination cover 18 to the open position. The slave piston rod 19 may be in the extracted position for the coupling switch 23 to be in simultaneous fluid communication with lines G and H. At the extracted position of the slave rod 19 fluid may flow from line G to line H.

Figure 4:
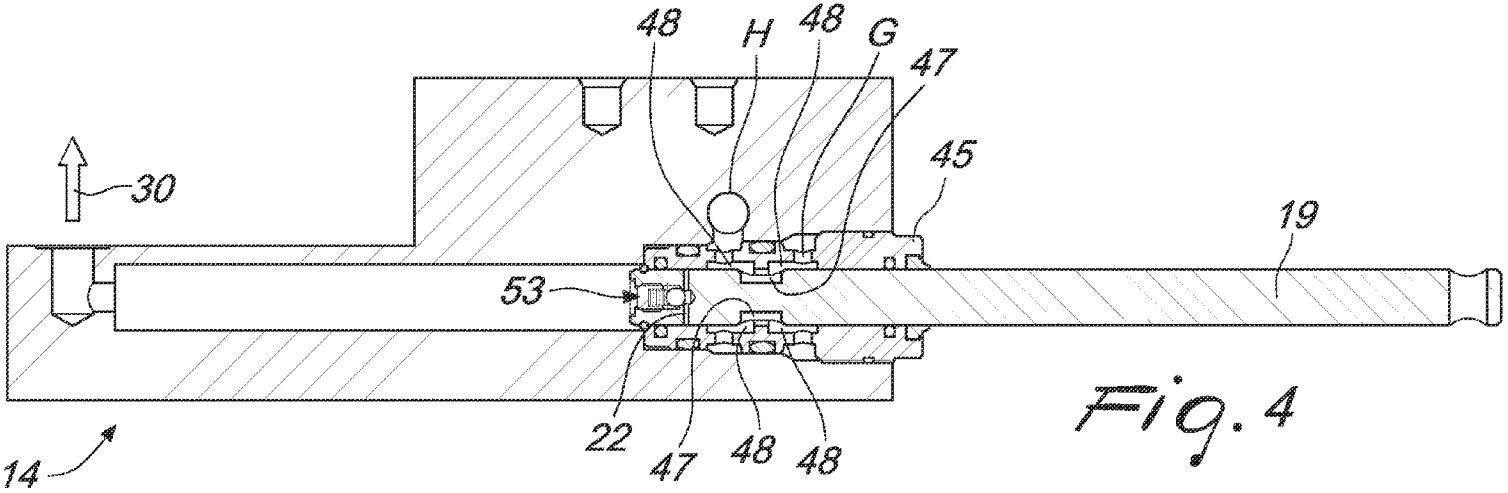
FIG. 4 is a cross-sectional view of a slave cylinder at an extracted position according to the present disclosure.

FIG. 4 illustrates a cross-section of the slave cylinder 14 in an extracted position. The coupling switch 23 may comprise a piston-rod recess portion 48 disposed on the slave piston rod 19 and a piston-head recess portion 47 disposed on a piston head 45.

The coupling switch 23 may be in simultaneous fluid communication with lines G and H, with openings of lines G and H leading to the piston-head recess portion 47 and when the piston-rod recess portion 47 is positioned adjacent to the piston-head recess portion 48.

In an embodiment, the coupling switch 23 may comprise a piston-rod recess portion 47 disposed on the slave piston rod 19. The coupling switch 23 may be in simultaneous fluid communication with lines G and H, with openings of lines G and H being positioned adjacent the piston-rod recess portion 47.

The coupling switch 23 may not be in fluid communication with lines G and H when the biasing element 17 moves the contamination cover 18 to the closed position. The slave piston rods 19 may be retracted so that the coupling switch 23 may no longer be in fluid communication with lines G and H. The lines G and H may be sealed by the slave piston rod 19.

Figure 5:
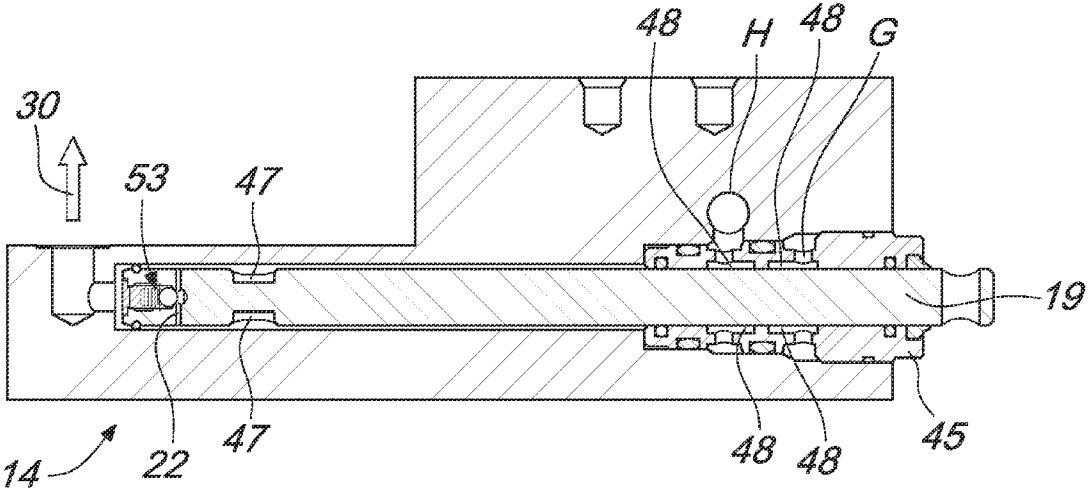
FIG. 5 is a cross-sectional view of a slave cylinder at a retracted position according to the present disclosure.
Figure 6:
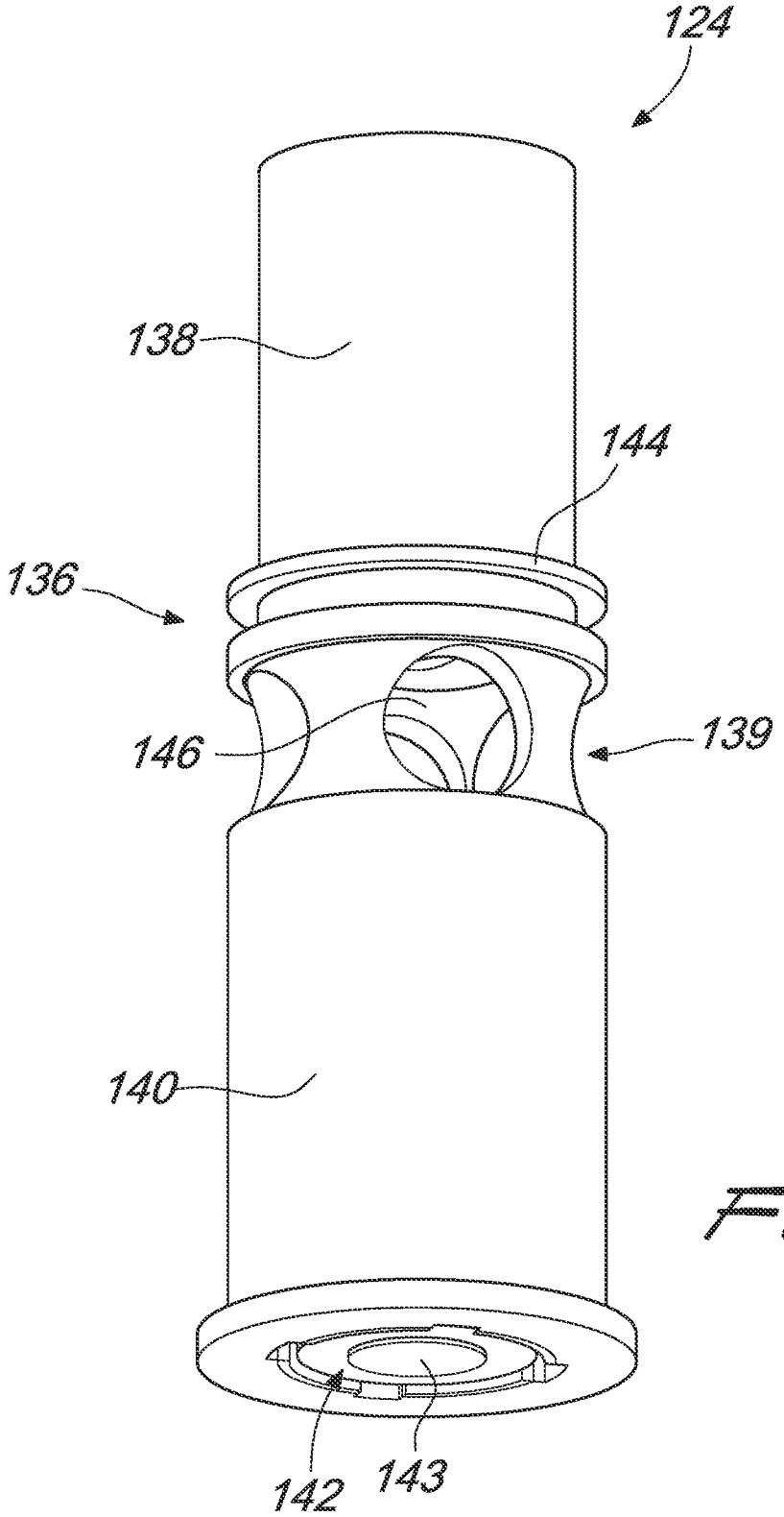
FIG. 6 is an isometric view of an embodiment of a coupling assembly according to the present disclosure.
Figure 8:
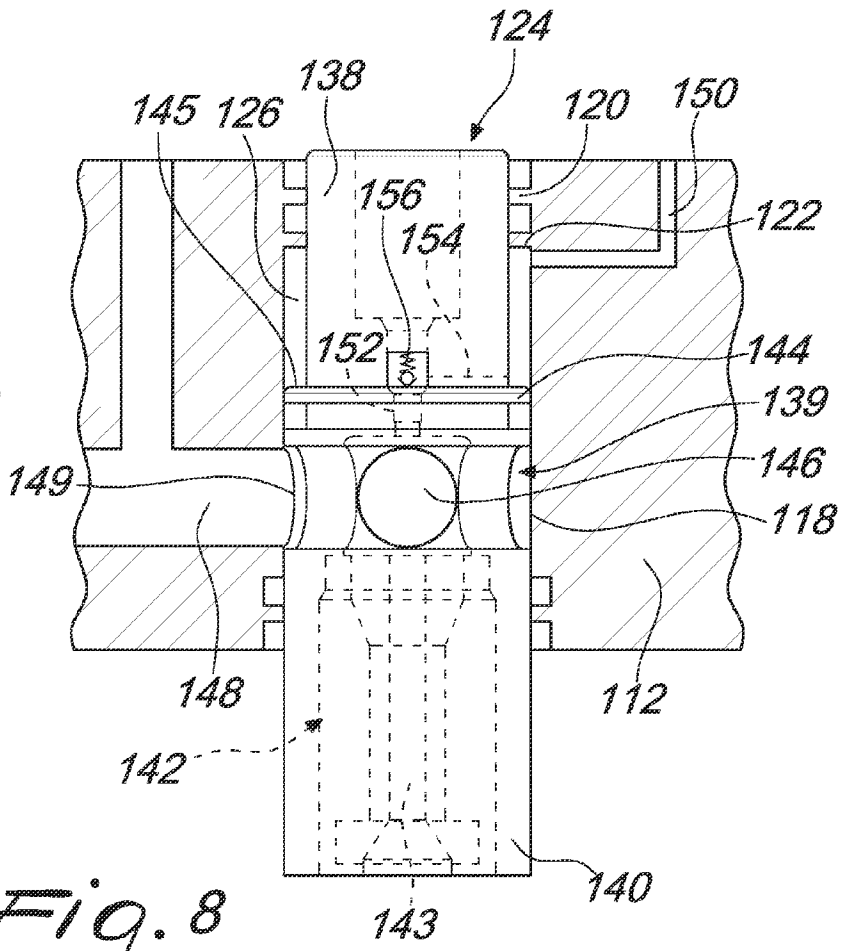
FIG. 8 is a cross sectional view of a mounted coupling assembly in an extended position according to the present disclosure.
Figure 7:
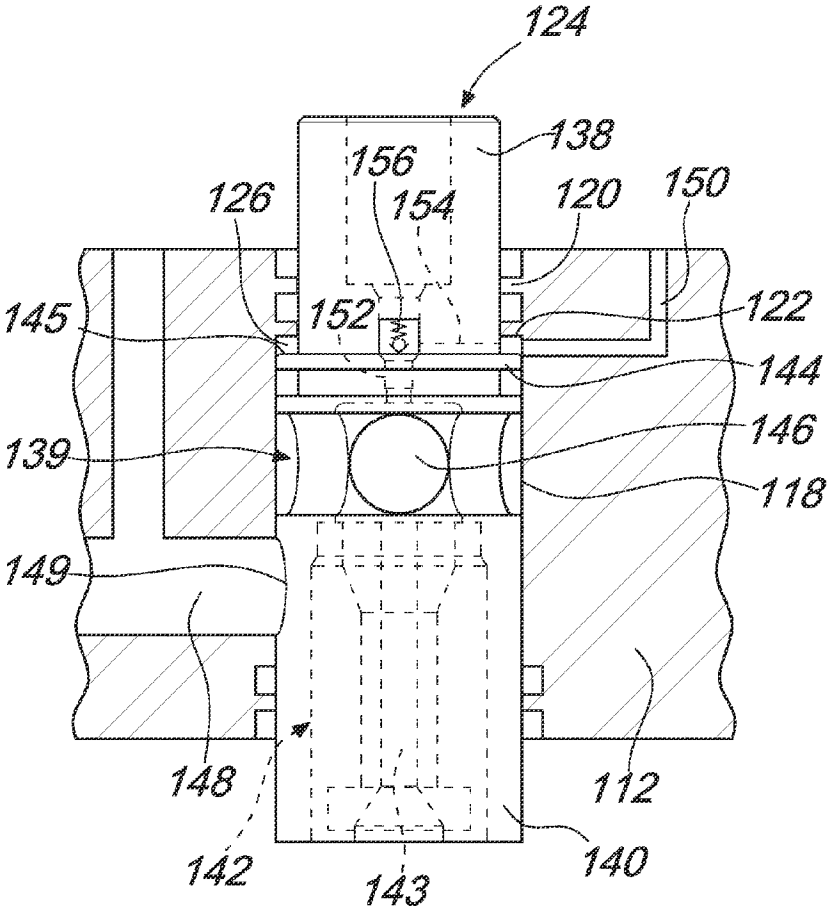
FIG. 7 is a cross sectional view of a mounted coupling assembly in a retracted position according to the present disclosure.

FIG. 5 illustrates a cross-section of the slave cylinder 14 in a retracted position. The coupling switch 23 may not be in simultaneous fluid communication with lines G and H, when the piston-rod recess portion 48 is in a distant position from the piston-head recess portion 49.

In an embodiment, the coupling switch 23 may not be in simultaneous fluid communication with lines G and H, with openings of lines G and H being in a distant position from the piston-rod recess portion 48.

The device 10 may comprise a bore 22 provided in the first slave cylinder 14 and/or the second slave cylinder 15. The device 10 may comprise a bore 22 provided in the slave piston rod 19 of the first slave cylinder 14 and/or the slave piston rod 19 of the second slave cylinder 15.

In an embodiment, the bore 22 may be coupled to the coupling switch 23.

The bore 22 may permit fluid communication between the master-slave circuit 16 and the actuation fluid circuit 9. The bore 22 may permit flow of hydraulic fluid from the actuation fluid circuit 9 to the master-slave circuit 16. The bore 22 may permit flow of hydraulic fluid from the actuation fluid circuit 9 to the master-slave circuit 16 when the slave piston rod 19 moves the contamination cover 18 to the open position and the coupling switch 23 may be in simultaneous fluid communication with lines G and H.

A loss of hydraulic fluid from the master-slave circuit 16 may result in a difference of speed or displacement between slave piston rods 19 of the first slave cylinder 14 and the second slave cylinder 15.

The bore 22 may allow a re-calibration of the master-slave circuit 16 by permitting flow of hydraulic fluid from the actuation fluid circuit 9 to the master-slave circuit 16. The re-calibration may occur if the master-slave circuit 16 requires fluid replacement.

The device 10 may further comprise a one-way valve 53 provided in the bore 22 of the first slave cylinder 14 and/or the second slave cylinder 15. The one-way valve 53 may allow flow of hydraulic fluid from the actuation fluid circuit 9 to the master-slave circuit 16 through the coupling switch 23. The one-way valve 53 may prevent flow of hydraulic fluid from the master-slave circuit 16 to actuation fluid circuit 9.

The device 10 may further comprise a pressure relief valve 30. The pressure relief valve 30 may be provided on a fluid line 28 which is connected to the master-slave circuit 16. The fluid line 28 may be connected to fluid line 21.

The pressure relief valve 30 may be provided to relieve excess pressure as a result of an external force that may be applied to the master-slave circuit 16. The pressure relief valve 30 may be adjusted so that the pressure in the master-slave circuit 16 may be sufficient for smooth transition of the contamination cover 18.

The pressure in the master-slave circuit 16 may be at 0 bar at the closed position of the contamination cover 18. At the closed position of the contamination cover 18, the master cylinder 12 may be extracted and the slave cylinders 14, 15 may be retracted.

At coupling of a work tool bracket 114 to a machine bracket 112, the work tool bracket 114 or the fluid connectors disposed therein may abut the link member 36 or the interference element 42. The abutment may result in an increase of pressure in the master-slave circuit 16. The pressure may increase approximately between 30-40 bar. The pressure may increase due to the compression of the biasing elements 17. The pressure relief valve 30 setting may be higher than this pressure increase. The pressure relief valve 30 setting may be higher than an operating pressure of the actuation fluid circuit 9, which may be 70 bar. In an embodiment, the pressure relief valve 30 may be set at approximately 90 bar.

If the contamination cover 18 may become obstructed during transition from the closed position to the open position, the pressure may be raised above normal operating levels and the burst pressure of the pressure relief valve 30 may be reached. Any excess pressure will be relieved into a drain circuit 176 to avoid mechanical damage to the components. The fluid line 28 may be connected to the drain circuit 176.

Excessive oil in the system may be relieved into the drain circuit 176 through the pressure relief valve 30.

The master-slave circuit 16 may be re-calibrated when the contamination cover 18 may be subsequently opened.

The Device 10 may be provided with a bypass line 32. Bypass line 32 may form a bypass to a pressure regulator 158. Bypass line 32 may form a bypass to a bracket switch 130. Bypass line 32 may connect line X directly to line G. A valve 34 may be provided on the bypass line 32. In an embodiment, the valve 34 may be a ball valve.

The valve 34 may be actuated to permit fluid flow through bypass line 32 only during an air purge sequence.

The device 10 may be configured to purge trapped air from the master-slave circuit 16 through an application of a pressure at pressure relief valve 30 that is greater than the normal operating pressure. The pressure relief valve 30 while having a pressure setting lower than the maximum pressure in a hydraulic power circuit 135. may be subjected to a pressure greater than the normal operating pressure in order to relief trapped air during assembly/testing.

When valve 34 is opened for purging of trapped air the pressure relief valve 30 may be opened. The pressure regulator 158 may be bypassed through the valve 34 to form a higher pressure than normal operation in the master-slave circuit 16. The pressure from hydraulic power circuit 135 may the be directed straight to the master-slave circuit 16.

During normal operation, the pressure in the master-slave circuit 16 and the actuation fluid circuit 9 may be approximately 70 bar. When valve 34 is opened, the pressure in the master-slave circuit 16 may be raised to 123 bar. As bracket switch 130 may not actuated during test/purging of the master-slave circuit 16 and the raised pressure will not be transmitted to the actuation fluid circuit 9. Burst pressure of pressure relief valve 30 may be selected to be at a level so that the pressure relief valve 30 will only open when the valve 34 is opened.

When valve 34 is closed, the prevailing pressure in the master-slave circuit 16 and the actuation fluid circuit 9 may be at the burst pressure of pressure regulator 158. The relief of trapped air may be performed prior commencement of normal operations.

Trapped air may be removed from the master-slave circuit 16 for device 10 to function suitably. The bore 22 may aid in removing the trapped air. By applying full pressure of the actuation fluid circuit 9 to the master-slave circuit 16 the pressure relief valve 30 may be opened and any trapped air may be purged. The maximum pressure of actuation fluid circuit 9 may be 120 bar.

Once the trapped air is removed from the system the pressure relief valve 30 may be closed and the connection between the actuation fluid circuit 9 and the master-slave circuit 16 may be closed. The master cylinder 12 and slave cylinders 14, 15 may be fully extracted. The extracted positions of the master cylinder 12 and slave cylinders 14, 15 may be corrected at the initial connecting sequence of the work tool bracket 114 to a machine bracket 112. The work tool bracket 114 or the fluid connectors disposed therein may abut the interference element 42. The abutment may result in the master piston rods 40, 41 being retracted. The retraction of the master piston rods 40, 41 may displace equal oil volumes to usually effect the extraction of the slave piston rods 19. In this situation the slave piston rods 19 may be already in the extracted position. The pressure will still increase in the master-slave circuit 16.

The pressure relief valve 30 may also effect relief of excessive pressure in the master-slave circuit 16 in the event the contamination cover 18 were to become obstructed The device 10 may further comprise a shuttle valve 44. The shuttle valve 44 may be provided in the fluid line 21 of the master-slave circuit 16. The shuttle valve 44 may be pressure actuated.

The channel in the shuttle valve 44 with the highest pressure may open until the pressure is equalised between slave cylinders 14, 15. The shuttle valve 44 may allows a single pressure relief valve 30 to be used in combination with the two slave cylinders 14, 15.

In operation of the device 10, the contamination control cover 18 may move from the closed position to the open position so that the fluid connectors disposed on the machine bracket 112 may be available to connect to fluid connectors disposed on a work tool bracket 114. The contamination cover 18 may remain closed if a work tool bracket 114 does not have fluid connectors or if a bucket is connected to the machine bracket 112.

A method of controlling a contamination cover 18 of a machine bracket 112, may comprise the steps of actuating the master cylinder 12 positioned on the machine bracket 112; and driving a first slave cylinder 14 positioned on the machine bracket 112 and hydraulically connected to the master cylinder 12 through a master-slave circuit 16 for transition of the contamination cover 18 from an open to a closed position.

At coupling of a work tool bracket 114 to a machine bracket 112, the machine bracket 112 may be rotated relative to the work tool bracket 114. At this stage the master cylinder 12 may be extracted and the contamination cover 18 may be in the closed position.

During the final part of the coupling, the work tool bracket 114 may abut against the link member 36. This final part of the coupling may be in the range of 10-15 degrees of the rotating movement. As the rotation of the machine bracket 112 continues, the link member 36 may be pushed such that the first master piston rod 40 may be retracted into the master cylinder barrel 50. An oil volume 20 from the master cylinder barrel 50 may be transferred to the first slave cylinders 14 resulting in the extraction of the slave piston rod 19.

As the slave piston rod 19 is extracted, the contamination cover 18 may be moved from the closed position to the open position. The biasing element 17 may be compressed as the contamination cover 19 is moved to the open position.

In an embodiment, as the rotation of the machine bracket 112 continues, the link member 36 may be pushed such that the first and the second master piston rods 40, 41 may be retracted into the respective master cylinder barrels 50, 51. An oil volume 20 from each master cylinder barrel 50, 51 may be transferred to the first and second slave cylinders 14, 15 resulting in the extraction of the respective slave piston rods 19.

As the slave piston rods 19 are extracted, the contamination cover 18 may be moved from the closed position to the open position. The biasing elements 17 may be compressed as the contamination cover 19 is moved to the open position.

When the machine bracket 112 reaches its end position relative to the work tool bracket 114, the master cylinder 12 may be moved to a final retracted position. The displaced oil volume 20 may cause the contamination cover 18 to move to the open position.

When the contamination cover 18 is at the open position, the bore 22 may allow a re-calibration of the master-slave circuit 16 by permitting flow of hydraulic fluid from the actuation fluid circuit 9 to the master-slave circuit 16. The re-calibration may occur if the master-slave circuit 16 requires fluid replacement.

When the contamination cover 18 is at the open position, the fluid may be permitted to flow through the actuation fluid circuit 9 by connecting a coupling switch 23 to the actuation fluid circuit 9. The coupling switch 23 may connect lines G and H.

The master-slave circuit 16 may act independently from the actuation fluid circuit 9. If the contamination cover 18 is not entirely open, coupling switch 23 may not be in fluid communication with lines G and H and fluid may not be permitted to flow through the actuation fluid circuit 9.

At decoupling of a work tool bracket 114 to a machine bracket 112, the link member 36 may not be in abutting contact with the work tool bracket 114 or the fluid connectors disposed therein. The biasing elements 17 in the compressed state may move the contamination cover 18 from the open position to the closed position. The biasing elements 17 may ensure smooth closure of the contamination cover 18 when the work tool bracket 114 and the machine bracket 112 are being decoupled.

The slave piston rods 19 may be retracted causing the oil volumes 20 to be transferred to the master cylinder barrels 50, 51 of the master cylinder 12. The displacement of the oil volumes 20 may cause the first and second master piston rods 40, 41 to be extracted. In the absence of an abutting engagement of the work tool bracket 114 and the link member 36, the movement of the first and second master piston rods 40, 41 may not be restricted.

FIG. 2 further illustrates a schematic representation of an embodiment of a coupling arrangement 110 with hydraulic connections for connecting a machine bracket 112 to a work tool bracket 114 and for forming at least one fluid passage between the machine fluid circuit and the work tool fluid circuit.

The coupling arrangement 110 may comprise the machine bracket 112 which may be provided with at least one cavity 116. The cavity 116 may extend through the machine bracket 112 and may have a cavity wide portion 118 and a cavity narrow portion 120.

Cavity narrow portion 120 may be formed as a plurality of extensions of the wall of cavity 116. In an embodiment, the cavity narrow portion 120 may be a single block extension of the wall of cavity 116. A shoulder 122 may be formed between the cavity wide portion 118 and the cavity narrow portion 120.

The coupling arrangement 110 may comprise a coupler assembly 124 movably mounted in the cavity 116. Both the cavity 116 and the coupler assembly 124 may be correspondingly shaped to allow for the relative movement of the coupler assembly 124. The coupler assembly 124 may be slidably mounted with at least portions thereof being in sliding engagement with the wall of the cavity 116. The coupler assembly 124 may slide between a retracted position, where the coupler assembly 124 retracts fully or partially into the cavity 116, and an extended position, where the coupler assembly 124 protrudes from the machine bracket 112 for engagement with a corresponding fluid coupler in the work tool bracket 114.

The coupling arrangement 110 may comprise a chamber 126 provided in the cavity 116. In an embodiment the chamber 126 may be formed in the cavity wide portion 118 and may be bounded by the wall of the cavity wide portion 118, the shoulder 122 and the coupler assembly 124.

The size of chamber 126 may vary through the movement of the coupler assembly 124 relative to the machine bracket 112. The size of chamber 126 may be made to vary through the inflow and outflow of hydraulic fluid which may move the coupler assembly 124 relative to the machine bracket 112. The changes in the size of the chamber 126 may effect the corresponding retraction and extension of the coupling assembly 124.

In an embodiment the machine bracket 112 may be provided with a series of cavities 116. Each cavity 116 may have a movably mounted coupler assembly 124 and a chamber 126. For fluid coupling the machine bracket 112 to a work tool bracket 114, the work tool bracket 114 may comprise fluid couplers which connect to corresponding coupler assemblies 124 mounted in the machine bracket 112. Fluid coupling the machine bracket 112 to a work tool bracket 114 may be effected with the coupler assemblies 124 in the fully extended positions or the connect position. The coupler assemblies 124 may be in a disconnect position when retracted from the fully extended position.

For operation and control of the coupling arrangement 110 the hydraulic connections may be suitably provided. The machine fluid circuit may comprise hydraulic lines leading to the cavities 116 for connection to respective coupler assemblies 124. In an embodiment, hydraulic lines A, B, C, D and L of the machine fluid circuit may allow flow of hydraulic fluid to and from the work tool fluid circuit when fluid coupling between the brackets 112, 114 are established. Hydraulic fluid may flow through the coupler assemblies 124 in the connect position to and from the corresponding fluid couplers in the work tool bracket 114.

The coupling arrangement 110 may include hydraulic connections to a quick coupler mechanism for locking together brackets 112, 114, such as a quick coupler wedge.

The actuation fluid circuit 9 may be controlled independently from the machine fluid circuit. The actuation fluid circuit 9 may include at least one actuator 128. In an embodiment, the actuator may be a hydraulic cylinder. The actuator 128 may be connected contemporaneously to all the coupler assemblies 124. The actuator 128 may be connected to the coupler assemblies 124 through suitable linkages such as through a connecting rod.

Retraction or extension of the actuator 128 may correspondingly retract or extend the coupler assemblies 124 to a disconnect position or to a connect position respectively. The coupler assemblies 124 may be uniformly retracted or extended by the actuator 128. In an embodiment, a pair of actuators 128 may be provided to ensure an evenly balance load for fluid coupling or decoupling between the coupler assemblies 124 and the corresponding fluid couplers.

The operation of the actuation fluid circuit 9 may be controlled by the device 10 through the connection and disconnection of coupling switch 23 and the lines G and H.

The operation of the actuation fluid circuit 9 may be further controlled by the bracket switch 130.

Bracket switch 130 may control hydraulic fluid flow for the extension of the coupler assemblies 124. Bracket switch 130 may be suitably disposed in order to detect when a work tool bracket 114, having at least one corresponding fluid coupler, is mounted to a machine bracket 112. In an embodiment, the bracket switch 130 may be suitably positioned on the machine bracket 112. The bracket switch 130 may not be activated if the work tool bracket 114 does not carry any corresponding fluid couplers and fluid coupling may not be effected as no flow of hydraulic fluid to extend the coupler assemblies 124 to the connect position is permitted by the bracket switch 130. Bracket switch 130 may prevent actuation of the coupler assemblies 124 when no corresponding fluid couplers are present in the attached work tool bracket 114.

The operation of the machine fluid circuit may be further controlled by a switch 132. Switch 132 may control the flow of hydraulic fluid to a locking device 134 for the unlocking of the brackets 112, 114. Switch 132 may be arranged to be activated only when the actuator 128 is in a fully retracted position. The switch 132 may be arranged not to be activated when the actuator 128 is in an extended position and unlocking of the brackets 112, 114 may not be effected as no flow of hydraulic fluid to actuate the locking device 134 is permitted by the switch 132. Switch 132 prevents premature decoupling between the machine bracket 112 and the work tool bracket 114 when coupler assemblies 124 have not been retracted from the connect position.

In an embodiment the switches 130, 132 may be sensors connected to actuating mechanisms. In an embodiment the switches 130, 132 may be a solenoid or a hydro mechanical device. In an embodiment the switches 130, 132 may be hydromechnical switches which are activated upon physical contact with work tool bracket 114 and the actuator 128.

The coupling arrangement 110 may further comprise a rail circuit 113, denoted by a bold line in FIG. 2, which connects together each chamber 126. The rail circuit 113 may be comprised of a single hydraulic line connected to each of the chambers 126 through further hydraulic lines. The rail circuit 113 may distribute the fluid pressure equally among the chambers 126. Accordingly, the highest pressure in any one chamber 126 may generate the load required to effect the corresponding extension of the coupler assemblies 124 in the other chambers 126. The chamber 126 having the highest working pressure may define the force presented to all coupler assemblies 124.

A diagnostic line 46 may be provided for the testing and analysis of the rail circuit 113.

The rail circuit 113 may be connected to the actuators 128. In an embodiment, the rail circuit 113 may be connected to the piston side of the actuators 128, provided as a hydraulic cylinder.

The coupling arrangement 110 may be connected to the hydraulic power circuit 135. The hydraulic power circuit 135 may provide hydraulic pressure to lock and unlock machine bracket 112 to the work tool bracket 114. Unlocking of the brackets 112, 114 by the hydraulic power circuit 135 may be controlled by the switch 132 through hydraulic connections between the hydraulic power circuit 135 and the switch 132.

The hydraulic power circuit 135 may be connected to the actuator 128. In an embodiment, the hydraulic power circuit 135 may be connected to the rod side of the actuator 128, provided as a hydraulic cylinder.

The hydraulic power circuit 135 may be arranged to provide pressurized fluid to the rail circuit 113. The coupling switch 23 and the bracket switch 130 may be disposed in the connection between the hydraulic power circuit 135 and the rail circuit 113.

FIG. 3 illustrates a coupler assembly 124. The coupler assembly 124 may comprise a hollow plunger 136. Plunger 136 may have a suitable form and dimensions to be slidingly mounted within the cavity 116. Plunger 136 may have a plunger narrow portion 138, a gate portion 139 and a plunger wide portion 140. In an embodiment, the gate portion 139 may be positioned within the plunger wide portion 140 and adjacent to the plunger narrow portion 138. The gate portion 139 may be recessed from the plunger wide portion 140.

The plunger narrow portion 138 may be in sliding engagement with the cavity narrow portion 120. The plunger narrow portion 138 may be arranged to sealingly engage with cavity narrow portion 120 to restrict leakage of hydraulic fluid between the plunger narrow portion 138 and the cavity narrow portion 120.

The plunger wide portion 140 may be in sliding engagement with the cavity wide portion 118. The plunger wide portion 140 may be arranged to sealingly engage with cavity wide portion 118 to restrict leakage of hydraulic fluid between the plunger wide portion 140 and the cavity wide portion 118.

The gate portion 139 may not be in contact with wall of the cavity wide portion 118.

A fluid coupler 142 may be positioned within the plunger 136. Plunger 136 may be provided with retaining structures to hold the fluid coupler 142 within the walls thereof. Fluid coupler 142 may have a through fluid channel 143 along the longitudinal axis of the plunger 136. The fluid channel 143 may communicate with the hollow of the plunger 136.

The fluid coupler 142 may couple with the corresponding fluid coupler, having a fluid channel disposed therein, in the work tool bracket 114. Respective fluid channels form a fluid passage when the fluid couplers are connected. At fluid coupling hydraulic fluid from the machine fluid circuit may flow through the fluid channels to the work tool fluid circuit. Fluid coupler 142 may be formed as a male or female element for coupling to the fluid coupler with the corresponding form.

Extending laterally from the plunger 136 may be a pressure element 144. In an embodiment the pressure element 144 may encircle the plunger 136 and may be formed as a rib or a protrusion. In an embodiment the pressure element 144 may extend from and encircle the plunger wide portion 140. With the coupler assembly 124 mounted in the cavity 116, the pressure element 144 may extend from the plunger 136 through the cavity 116 to slidingly engage the wall of the cavity wide portion 118. The pressure element 144 may separate the chamber 126 from rest of the cavity wide portion 118.

The pressure element 144 may be arranged to sealingly engage with the wall of the cavity wide portion 118 to limit leakage of hydraulic fluid between the wall of the cavity wide portion 118 and the pressure element 144. The pressure element 144 may be suitably shaped or may be provided with a gasket to slidingly and sealingly engage cavity wide portion 118.

The pressure element 144 may have a pressure surface 145 which, in an embodiment, may face the shoulder 122. The dimensions and/or shape of the pressure surface 145 may be a function of the diameter of the coupler assembly 124, the diameter of the fluid coupler 142, the diameter of the corresponding fluid coupler in the work tool bracket 114 and/or the difference in the diameters of the fluid coupler 142 and the corresponding fluid coupler. The dimensions and/or shape of the pressure surface 145 may depend on the fluid dynamics of the fluid coupler 142 and the corresponding fluid coupler. Fluid dynamics may be dependent on the structure of fluid couplers, the type of hydraulic fluid and/or the fluid pressure used for the fluid coupling.

At least one bore 146 may be provided in the plunger 136 which may allow flow of hydraulic fluid from the exterior of the plunger 136 into the hollow thereof. The fluid channel 143 of the fluid coupler 142 may communicate through the hollow of the plunger 136 with the bore 146. The bore 146 may be provided in the gate portion 139. In an embodiment, the gate portion 139 may be provided with a plurality of bores 146. Hydraulic fluid may flow around the gate portion 139 guided by walls formed by the plunger wide portion 140 and into the hollow through the plurality of bores 146.

In an embodiment, a single bore 146 may be provided in the plunger 136, not provided with a gate portion 139. The bore 146 may be positioned between the pressure element 144 and the plunger wide portion 140.

The size and the number of the bores 146 may be a function of the diameter of the coupler assembly 124, the diameter of the fluid coupler 142, the diameter of the corresponding fluid coupler in the work tool bracket and/or the difference in the diameters of the fluid coupler 142 and the corresponding fluid coupler. The dimensions and/or shape of the bore 146 may be dependent on the dimension and/or shape of the pressure surface 145. The dimensions and/or shape of the bore 146 may depend on the fluid dynamics of the fluid coupler 142 and the corresponding fluid coupler.

FIGS. 4 and 5 illustrate a coupler assembly 124 slidingly mounted in the machine bracket 112. In FIG. 4 the coupler assembly 124 may be retracted to the disconnect position and in FIG. 5 the coupler assembly 124 may be extracted to the connect position. The retraction of the coupler assembly 124 within the cavity 116 may be limited by the shoulder 122 which may abut pressure surface 145.

Machine bracket 112 may have a machine circuit line 148, which forms part of the machine fluid circuit, leading to the cavity 116. Fluid from the machine fluid circuit may flow through the machine circuit line 148 to the cavity 116 through a port 149. In the machine bracket 112 having plurality of cavities 116, each cavity 116 may be separately connected to the machine fluid circuit through a plurality of corresponding circuit lines 148. In an embodiment, hydraulic lines A, B, C, D and L may allow flow of hydraulic fluid to and from the ports 149 through respective machine circuit lines 148.

Machine bracket 112 may have a rail circuit line 150, which forms part of the rail fluid circuit, leading to the cavity 116. In an embodiment the rail circuit line 150 leads to the chamber 126. Fluid from the rail fluid circuit may flow through the rail circuit line 150 to the chamber 126.

The chamber 126 in the cavity wide portion 118 may be bounded by the wall of the cavity wide portion 118, the shoulder 122, the pressure surface 145 and the plunger narrow portion 138. The size of chamber 126 may depend on the inflow and outflow of hydraulic fluid through the rail circuit line 150. Inflow of fluid into the chamber 126 may result in an increase in fluid pressure therein, as the chamber 126 may be fluid tight. The fluid pressure may act on the surfaces which bound the chamber 126. The increasing fluid pressure acting on the pressure surface 145 may effect extraction of the coupler assembly 124 slidingly mounted in the machine bracket 112. The coupler assembly 124 may be extracted to the connect position through continued inflow of hydraulic fluid under pressure to establish fluid coupling between the fluid coupler 142 and the corresponding fluid coupler in the work tool bracket 114.

A diversion passage 152 may extend axially within the plunger 136 from the gate portion 139 toward the pressure element 144. The diversion passage 152 may be axially aligned with the longitudinal axis of the plunger 136. In an embodiment the diversion passage 152 may extend beyond the pressure element 144. Hydraulic fluid flowing through the bores 146 may flow into the hollow of the plunger 136 and to the diversion passage 152.

The dimensions and/or shape of the diversion passage 152 may be a function of the diameter of the coupler assembly 124, the diameter of the fluid coupler 142, the diameter of the corresponding fluid coupler in the work tool bracket and/or the difference in the diameters of the fluid coupler 142 and the corresponding fluid coupler. The dimensions and/or shape of the diversion passage 152 may be dependent on the dimension and/or shape of the bore 146. The dimensions and/or shape of the diversion passage 152 may be dependent on the dimension and/or shape of the pressure surface 145. The dimensions and/or shape of the diversion passage 152 may depend on the fluid dynamics of the fluid coupler 142 and the corresponding fluid coupler.

Extending from the diversion passage 152 may be a diversion line 154. The diversion line connects the diversion passage 152 to the chamber 126. In an embodiment the diversion line 154 may extend laterally from the diversion passage 152 to the chamber 126. In an embodiment, the diversion line 154 may be disposed such that the pressure surface 145 is positioned between the bores 146 and the diversion line 154. In an embodiment the diversion passage is a hose mounted externally to the plunger 136. In an embodiment, the diversion line 154 may have a smaller diameter than diversion passage 152 such that the fluid pressure increases as the hydraulic fluid enters the diversion line 154. Hydraulic fluid flowing into the bore 146 may flow through the diversion passage 152 and the diversion line into the chamber 126.

A check valve 156 may be provided at the junction of the diversion passage 152 and the diversion line 154. The check valve 156 may permit flow of fluid from the diversion passage 152 to diversion lines 154 and prevent flow of fluid from the diversion line 154 to diversion passage 152. In an embodiment, check valve 156 may be disposed such that the pressure surface 145 is positioned between the bore 146 and the check valve 156.

With reference to FIG. 4 the coupler assembly 124 is retracted and may be disconnected from the corresponding fluid coupler. The gate portion 139 may be recessed into the cavity wide portion 118. The gate portion 139 may be sealed from fluid entry by the cavity wide portion 118. Port 149 of the machine circuit line 148 may be sealed by the plunger wide portion 140.

In an embodiment, bore 146, in the plunger 136 not provided with a gate portion 139, may be recessed into the cavity wide portion 118 and may be sealed from fluid entry by the cavity wide portion 118.

With reference to FIG. 5 the coupler assembly 124 is extended and may be connected to the corresponding fluid coupler. The gate portion 139 may be positioned to be in fluid communication with the port 149 of the machine circuit line 148. Fluid may flow from the machine circuit line 148 through port 149 and into the gate portion 139. Hydraulic fluid may flow around the gate portion 139 and into the hollow of plunger 136 through the plurality of bores 146.

In an embodiment, when the gate portion 139 is in fluid communication with machine circuit line 148 the coupler assembly 124 may be at a fully extended position. In an embodiment, the gate portion 139 may have dimension and/or shape which corresponds to the port 149.

In an embodiment with plunger 136 not provided with a gate portion 139, when the coupler assembly 124 is extended the bore 146 may be positioned to be in fluid communication with the port 149 of the machine circuit line 148. Fluid may flow from the machine circuit line 148 through port 149 and into the bore 146. Hydraulic fluid may flow into the hollow of plunger 136 through the bore 146.

In an embodiment, the bore 146 may have dimension and/or shape which corresponds to the port 149. In an embodiment, when the bore 146 is in fluid communication with machine circuit line 148 the coupler assembly 124 may be at a fully extended position.

A coupling arrangement 110 for fluid coupling a work tool 103 to a machine 101, the coupling arrangement 110 comprising at least one coupler assembly 124 slideably mounted for coupling a machine fluid circuit and a work tool fluid circuit at a connect position; an actuation fluid circuit 9 arranged to actuate the at least one coupler assembly 124 from a disconnect position to the connect position; a sensor 130 to detect presence of the work tool for activation of the actuation fluid circuit 9; and a device 10 to control a contamination cover 18 of a machine bracket 112, the device 10 comprising a master cylinder 12 positioned on the machine bracket 112; a first slave cylinder 14 positioned on the machine bracket 112 and connected to the contamination cover 18; and a master-slave circuit 16 connecting the master cylinder 12 to the slave cylinder 14 wherein the actuation of the master cylinder 12 drives the slave cylinder 14 for the transition of the contamination cover 18 from a close to an open position.

In an embodiment, the device 10, comprised in the coupling arrangement 110, may further comprise a second slave cylinder 15 which is hydraulically connected to the master cylinder 12. The second slave cylinder 15 may be positioned on the machine bracket 112. The second slave cylinder 15 may be connected to the contamination cover 18. The slave piston rod 19 may be connected to the contamination cover 18. The movement of the slave piston rod 19 of the second slave cylinder 15 in conjunction with the slave piston rod 19 of the first slave cylinder 14 may effect the transition of the contamination cover 18 between the open and closed positions.

With reference to FIG. 2, the operation of the coupling arrangement 110 may be initiated by coupling a machine bracket 112 to a work tool bracket 114. The hydraulic power circuit 135 may be activated to actuate a locking device 134 to lock machine bracket 112 to the work tool bracket 114. The locking device 134 may be actuated to lock the brackets 112, 114 through increased fluid pressure through line X. In an embodiment, the increased fluid pressure may act on the rod side of the locking device 134.

Upon locking of the brackets 112, 114, pressure in the hydraulic lines may increase further. The pressure regulator 158 may be connected to line X. Pressure regulator 158 may open only when the locking pressure in the locking device 134 is higher than a preset value of the pressure regulator 158. In an embodiment, the value is selected from the range of 60 bar-90 bar. In an embodiment, the value is 53 bar. Flow of hydraulic fluid to the bracket switch 130 and the rail circuit 113 may be prevented before the brackets 112, 114 are mechanically locked.

Hydraulic fluid may flow to the bracket switch 130 when the pressure regulator 158 opens to permit fluid flow. Bracket switch 130 may be activated if the work tool bracket 114, carrying a corresponding fluid coupler, is coupled to the machine bracket 112. Activation of the bracket switch 130 may effect the actuation of a valve 160 to permit flow of fluid to the device 10.

The fluid may flow through line G to the first slave cylinder 14. In an embodiment, the fluid may flow through lines G to the first and second slave cylinders 14, 15. The fluid may be permitted to flow to lines H when the coupling switch 23 may connect lines G and H.

The coupling switch 23 may be in fluid communication simultaneously with lines G and H when the slave piston rods 19 move the contamination cover 18 to the open position. The slave piston rods 19 may be in the extracted positions for the coupling switch 23 to be in simultaneous fluid communication with lines G and H.

The fluid in line H may flow to check valve 162.

Check valve 162 may permit fluid to flow into the rail circuit 113 and through rail circuit lines 150 to the chambers 126. Increased flow of fluid in the chambers 126 results in increased fluid pressure therein. The fluid pressure may act on the pressure surfaces 145 of the coupler assemblies 124 effecting extension from the disconnect position to an extended position at which a fluid coupling between the fluid couplers 142 and the corresponding fluid couplers in the work tool bracket 114 is established. The build up of pressure in chamber 126 may not enter the hollow of plunger 136 as a result of the check valve 156 which blocks the flow of fluid from the diversion line 154 to the diversion passage 152.

In an embodiment, check valve 162 may permit fluid to flow through the rail circuit 113 to the piston side of the actuators 128. Increased flow of fluid into the piston side chambers of the actuators 128 may result in increased fluid pressure therein to effect extension of the actuators 128. The actuators 128 may be connected to the coupler assemblies 124 and may effect a corresponding extension of the coupler assemblies 124. The extension of the coupler assemblies 124 through extension of the actuators 128 may be optional or may be in addition to the extension effected by the action of the pressurized fluid on the pressure surface 145.

Extraction of the coupler assemblies 124 through the pressure build up in the chambers 126 and/or extension of the actuators 128, may connect lines A, B, C, D and L through respective lines 148 and ports 149 to the hollows of plungers 136 to allow fluid flow from the machine fluid circuit into the hollow of plunger 136. If the machine fluid circuit is not actuated, fluid inside the hollow of plunger 136 may remain at atmospheric or tank pressure. Upon actuation of the machine fluid circuit the pressure in the lines 148 and the hollow of plunger 136 may increase.

At fluid coupling between the fluid couplers 142 and the corresponding fluid couplers, the gate portions 139 may be in fluid communication with ports 149 allowing fluid to flow through machine circuit lines 148 into the hollow of plunger 136. Fluid may then pass through fluid channels 143 in the fluid couplers 142 to the respective channels in the corresponding fluid couplers.

In an embodiment, at fluid coupling between the fluid couplers 142 and the corresponding fluid couplers, the bores 146 of each plunger 136 may be in fluid communication with ports 149 allowing fluid to flow through machine circuit lines 148 into the hollow of plunger 136. Fluid may then pass through fluid channels 143 in the fluid couplers 142 to the respective channels in the corresponding fluid couplers.

At fluid coupling between the fluid couplers 142 and the corresponding fluid couplers and flow of pressurized fluid through the respective fluid channels, separation forces may be generated which act on the fluid couplers. The separation forces may be countered by the fluid pressure acting on the pressure surface 145 and/or the actuators 128. In an embodiment, pressure in the chamber 126 may be sufficient to generate a force on the pressure surface 145 to maintain fluid coupling between the fluid couplers. In an embodiment, fluid coupling between the fluid couplers may be maintained through the pressure in the actuators 128 and the pressure in the chamber 126 acting on the pressure surface 145.

The separation forces generated may be dependent on the pressure of the fluid in the machine circuit. In an embodiment, an increase in the machine fluid circuit pressure may result in a higher separation force between the fluid couplers. The pressure surface 145 may be provided such that the difference in the ratio between the fluid coupler surfaces and pressure surface 145 is greater than 1 so that force acting on pressure surface 145 is greater than the separation force.

The chamber 126 may be connected to the machine fluid circuit via the check valve 156 mounted in the plunger 136. If pressure in the machine fluid circuit is higher than the pressure in the chamber 126, the fluid in the hollow of the plunger 136 may be at a higher pressure value and may flow to the chamber 126 where the fluid pressure has a lower pressure value. The fluid at a higher pressure will flow from the hollow of the plunger 136 through the diversion passage 152, the check valve 156 and the diversion line 154 into the chamber 126. The flow of fluid may continue till the pressure in the chamber 126 and pressure in the hollow of the plunger 136 equalise.

As the pressure in the chamber 126 generates a force on the pressure surface 145, the force acting on the pressure surface 145 may be equal to the separation forces generated by the fluid flowing from the hollow of plunger 136 through the fluid channels and which act on the fluid couplers. The equalising of pressures in the chamber 126 and the hollow of plunger 136 may serve to lock the coupler assemblies 124. As all chambers 126 are connected through the rail circuit 113, a higher pressure load in one chamber 126 may be distributed to the other chambers 126, even if the pressures in the hollow of the respective plungers 136 may be at a lower pressure value.

As fluid may not flow from the chamber 126 to the hollow of plunger 136, due to the check valve 156, the pressure in the chamber 126 may remain even when the pressure in the machine fluid circuit drops to a pressure value lower than the pressure value in the chamber 126. The pressure level may be available in the chambers 126 independent of the pressure in the hydraulic lines A, B, C, D and L of the machine circuit. As all chambers 126 are connected through the rail circuit 113, a balanced pressure load may be present to all coupler assemblies 124, even if the machine circuit pressure is lower or absent.

In an embodiment, check vale 162 may be pilot operated to block inflow of fluid having potentially damaging fluid pressures so as to avoid damage to components that may not be designed to withstand a high pressure. The check valve 162 may block high pressure in the rail circuit 113 from reaching the locking device 134.

In an embodiment, a pressure relief valve 164 may connect the rail circuit 113 to machine fluid circuit. The pressure relief valve 164 may be an adjustable pilot operated valve that is mounted to remove excessive pressure peaks generated in the machine fluid circuit that may be transmitted to the chambers 126 through the check valve 156 and the rail circuit 113. The pressure relief valve 164 may have pressure setting that is significantly higher than the maximum pressure tolerable in the chambers 126 and the rail circuit 113 to avoid unintended loss of force needed to maintain fluid coupling. In an embodiment, the pressure relief valve 164 may have pressure setting selected from the range of 390 bar-420 bar. In an embodiment, the pressure setting is 420 bar.

When the machine bracket 112 and work tool bracket 114 are brought in a coupled position the locking device 134 may be activated to lock the components mechanically.

A this stage, the bracket switch 130 and the coupling switch 23 may not be actuated to permit the flow of fluid. The contamination control cover 18 may be in the closed position.

At the activation of the locking device 134, line X may be pressurized up to 120 bar max and the cylinder of the locking device 134 may start to retract.

When the pressure in line X reaches a value of 53 bar pressure regulator 158 may open to permit fluid to flow to the bracket switch 130. Upon activation the bracket switch 130 may open. Line G may be pressurized at approximately 70 bar. Coupling switch 23 may be activated to connect lined G & H to permit fluid to flow to the rail circuit 113 so that the fluid connectors in the machine bracket 112 and work tool bracket 114 may start to engage. The master-slave circuit 16 may be re-calibrated.

If either of the bracket switch 130 or coupling switch 23 fails to be activated to permit flow of fluid the fluid connector engaging sequence may be stopped.

A method of coupling a work tool 103 to a machine 101, the method comprising providing at least one coupler assembly 124 slideably mounted for coupling a machine fluid circuit and a work tool fluid circuit; arranging an actuation fluid circuit 9 to actuate the at least one coupler assembly 124 from a disconnect position to the connect position; arranging a sensor 130 to detect presence of the work tool 103; and activating the sensor 130 when the work tool 103 is mounted to a machine bracket 112 to permit pressurized fluid to flow to a device 10; actuating a master cylinder 12 positioned on the machine bracket 112 of device 10; driving a first slave cylinder 14 positioned on the machine bracket 112 of device 10 and hydraulically connected to the master cylinder 12 through a master-slave circuit 16 for transition of a contamination cover from a close and to an open position to permit pressurized fluid to flow into the actuation fluid circuit 9 for actuating the coupler assembly 124 to the connect position.

With reference to FIG. 2, operation of the coupling arrangement 110 to decouple machine bracket 112 from the work tool bracket 114 may be initiated by relieving pressure in the chambers 126 and the rail circuit line 150 through the rail circuit 113.

In an embodiment, a drain circuit 176 for the rail circuit 113 may be provided through a normally-open drainage switch 166 and primary drainage check valves 168, 170. Drainage switch 166 may close to block the drain function, only when the chambers 126 and the rail circuit lines 150 are pressurized. The drainage switch 166 and primary drainage check valves 168, 170 may be provided on hydraulic return lines leading from the rail circuit 113 to the machine fluid circuit.

A drain circuit 176 for the rail circuit 113 may comprise a return fluid line 178 connecting the rail circuit 113 to a machine fluid circuit; the drainage switch 166 provided on the return fluid line 178; and at least one check valve 168, 170 provided on the return fluid line 178 upstream of the drainage switch 166 to prevent flow of the return fluid towards the drainage switch 166.

In an embodiment, the drain circuit 176 may include a branch return fluid line 180. The return fluid line 178 and the branch return fluid line 180 may connect the rail circuit 113 to two fluid lines A, D of the machine fluid circuit. The check valves 160, 170 may be separately positioned on the return fluid line 178 and the branch return fluid line 180. The primary drainage check valves 168, 170 may be connected to the return fluid line such that when one of the lines is depressurized the check valves 168, 170 may allow return fluid to flow back to the tank. The flow of the return fluid may be enabled by the depressurization in the lines. The return fluid may always flow into the lines which has been depressurized when the drainage switch is open.

In an embodiment primary drainage check valves 168, 170 may be connected to lines A and D, wherein either one of these lines may be depressurized to allow return fluid to flow back to the tank. The return fluid may consist of a fluid volume in the piston side of the actuators 128 and in the chambers 126.

The coupling arrangement 110 for decoupling the work tool 103 from the machine 101 may comprise a plurality of coupler assemblies 124 slideably mounted in a plurality of cavities 116, the coupler assemblies 124 partitioning the cavities 116 to form chambers 126; a rail circuit 113 connecting the chambers 126; and the drain circuit 176.

A method of reducing rail circuit 113 pressure for decoupling a work tool 103 from a machine 1 may comprise the steps of reducing pressure in chambers 126 and rail circuit lines 150 connecting the chambers 126 to the rail circuit 113 to open a drainage switch 166 positioned on a return fluid line 178; and reducing pressure in a machine fluid circuit line A, D connected to the return fluid line 178 to enable flow of return fluid from the rail circuit 113 to the machine fluid circuit.

In an embodiment, further primary drainage check valves may be provided which are connected to the other hydraulic lines.

Pressure in line X may relieved while line Y may be pressurized though the hydraulic power circuit 135. Fluid from line Y may flow into the rod side of the actuators 128. Increase in pressure in the rod side and the reduction of pressure in the piston side may effect a retraction of the actuators 128. As the actuators 128 are connected to the coupler assemblies 124, the coupler assemblies 124 may be correspondingly retracted and disconnected from fluid coupling. The full retraction of the actuators 128 may correspondingly effect complete retraction of the coupler assemblies 124 into the machine bracket 112.

A secondary drain circuit may consist of check valve 162 and secondary drainage check valve 172. The valves 162 and 172 may allow fluid to flow back to the tank through line X but only if line Y is pressurized. The return fluid may consist of a fluid volume in the piston side of the actuators 128 and in the chambers 126.

Switch 132 may detect the position of the actuators 128. Switch 132 may be normally closed and may block flow of fluid from the hydraulic power circuit 135 through line Y to locking device 134. At complete retraction of the actuators 128 the switch 132 may effect the actuation of the valve 173 to permit flow of fluid from the hydraulic power circuit 35 to the piston side of the locking device 134 to unlock the brackets 112, 114. This is a safety measure to avoid unintended operation of the locking device 134 if the coupler assemblies have not been retracted completely into the machine bracket 112.

A relief valve 174 may be provided in the hydraulic line connecting line Y and the rod sides of the actuators 128 to avoid any unintended drift of the actuators 128 in the disconnected position. The relief valve 174 may be pilot operated. The fluid in the rod side of the actuators 128 may be trapped unless chambers 126 and the lines 150 are pressurized to such level as to pressure regulator 158.

The skilled person would appreciate that foregoing embodiments may be modified to obtain the apparatus of the present disclosure.

INDUSTRIAL APPLICABILITY

This disclosure describes a device 10 and a coupling arrangement 110 for coupling a machine hydraulic fluid circuit to a work tool hydraulic fluid circuit.

In a machine 101, work tools 103 may be used for handling heavy materials. Work tools 103 may demolish, drill, dig, plow, cut, grab and/or carry heavy materials which may include sand, stone, metal, and more. Work tools 103 may be coupled to and powered by machines 101, in particular mobile host machines. The machine 101 may be provided with transmissions, hydraulic equipment, booms 102 and/or sticks for driving the work tool 103. Work tool operations may be controlled by the operator via an operating panel in the cab of the machine 101.

The device 10 may control the movement of the contamination cover 18 between the open and the closed positions. The contamination cover 18 may shield the fluid connectors disposed in a machine bracket 112 from contaminants. However, at coupling of a work tool 103 that may have fluid connectors to a machine 101, the contamination cover 18 may be moved from the closed position to the open position. The device 10 may move the contamination cover 18 from the closed position to the open position to enable the fluid connectors disposed in the machine bracket and the work tool bracket 114 to connect.

The device 10 may be actuated to move the contamination cover through the abutment of the work tool bracket 114 with a link member 36 or an interference element 42 provided on the link member 36.

The device 10 may comprise a coupling switch 23 as a part of the connecting control of the coupling arrangement 110 for coupling the machine 101 to the work tools 103. The device 10 permits flow of fluid to the actuation fluid circuit 9 only when the contamination cover 18 is at the open position. This check occurs before any fluid is directed to the rail circuit 113.

The coupling arrangement 110 may have at least one hollow plunger 136 provided with a check valve 156. The hollow plunger 136 may connect the machine fluid circuit to the rail fluid circuit through diversion passage 152 and diversion line 154. The fluid pressure in the machine fluid circuit may be used to retain the fluid coupling of the fluid couplers. The check valve 156 may restrict the fluid flow from the rail fluid circuit to the machine fluid circuit.

In operation of the coupling arrangement 110, pressure in the chambers 126 may be provided from either the rail fluid circuit, during the connection process, or the machine fluid circuit, during operation of the work tool. Check valves 156 and 162 may allow pressure to build up in the chambers 126. The prevailing pressure value in the chambers 126 may be the higher of the pressure values of the machine fluid circuit or the rail fluid circuit. This pressure in the chambers 126 may remain even if the pressure source is no longer available. Pressure relief valve 164 may protect the chambers 126, the rail circuit line 150 and the rail circuit 113 against damage as a result of excessive pressure.

The coupling arrangement 110 may have at least one hollow plunger 136 provided with a gate portion 139 having a plurality of bores 146 or a bore 146. When the coupler assemblies 124 are retracted to a disconnect position, the chambers 126 may be sealed from the hydraulic lines of the machine fluid circuit. At disconnection, the coupler assembly 124 may not be actuated unintentionally as a result of pressure build up in the hydraulic lines of the machine fluid circuit when fluid coupling has not yet been established.

The coupling arrangement 110 may have a rail fluid circuit to ensure a balanced load on the coupler assemblies 124. All chambers 126 may be connected through the rail fluid circuit to allow the highest pressure in any of the hydraulic lines of the machine fluid circuit or of the rail fluid circuit to generate the load required to retain fluid coupling between the fluid couplers.

The coupling arrangement 110 may have a bracket switch 130 to detect whether the work tool bracket 114 carries a corresponding fluid coupler. Bracket switch 130 may not permit fluid pressurisation of the rail fluid circuit when a work tool bracket 114 carrying a corresponding fluid coupler is not detected. The bracket switch 130 may avoid inefficient coupling present in devices wherein fluid connections are established simultaneously at mechanical coupling of the machine bracket and the work tool bracket.

The coupling arrangement 110 may have a switch 132 to detect whether the actuators 128 are fully retracted. The activation of switch 132 determines whether the locking device 134 may be actuated to unlock the brackets 112, 114 without the risk of potential damage to the fluid couplers and/or couplers assemblies 124.

The industrial applicability of the device 10 and the coupling arrangement 110 as described herein will have been readily appreciated from the foregoing discussion.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by references signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The invention claimed is:

1. A device to actuate a contamination cover on a machine bracket, the device comprising:

a master cylinder positioned on the machine bracket, the master cylinder comprising a master cylinder barrel and a piston connected to a master piston rod;

a first slave cylinder positioned on the machine bracket, the first slave cylinder comprising a slave cylinder barrel and a piston connected to a slave piston rod, wherein the slave piston rod is connected to the contamination cover; and a closed master-slave hydraulic circuit connecting the master cylinder to the first slave cylinder wherein actuation of the master cylinder drives the first slave cylinder for transition of the contamination cover between a closed position and an open position, wherein the master-slave circuit comprises fluid lines configured to connect a piston side chamber of the master cylinder to a piston side chamber of the first slave cylinder and to move a volume of oil between the master cylinder and the first slave cylinder, and wherein the slave piston rod is one of retracted into or extended from the slave cylinder barrel and the master piston rod is the other of retracted into or extended from the master cylinder barrel when the contamination cover is in the open position.

2. The device of claim 1 further comprising a second slave cylinder hydraulically connected to the master cylinder through the master-slave circuit and connected to the contamination cover.

3. The device of claim 2 wherein the master cylinder comprises a first master cylinder barrel hydraulically connected to the first slave cylinder and a second master cylinder barrel hydraulically connected to the second slave cylinder.

4. The device of claim 3 further comprising a coupling switch provided in at least one of the first and second slave cylinders, the coupling switch being configured to enable flow of fluid through an actuation fluid circuit.

5. The device of claim 3 wherein a first master piston rod is disposed in the first master cylinder barrel and a second master piston rod disposed in the second master cylinder barrel.

6. The device of claim 5 further comprising a coupling switch provided in at least one of the first and second slave cylinders, the coupling switch being configured to enable flow of fluid through an actuation fluid circuit.

7. The device of claim 5 wherein the first and second master piston rods are mutually coupled to a link member.

8. The device of claim 7 further comprising a coupling switch provided in at least one of the first and second slave cylinders, the coupling switch being configured to enable flow of fluid through an actuation fluid circuit.

9. The device of claim 7 wherein the link member comprises an interference element configured to abut a work tool bracket.

10. The device of claim 9 further comprising a coupling switch provided in at least one of the first and second slave cylinders, the coupling switch being configured to enable flow of fluid through an actuation fluid circuit.

11. The device of claim 2 further comprising a coupling switch provided in at least one of the first and second slave cylinders, the coupling switch being configured to enable flow of fluid through an actuation fluid circuit.

12. The device of claim 2 further comprising a bore provided in at least one of the first and second slave cylinders to permit fluid communication between the master-slave circuit and an actuation fluid circuit for flow of hydraulic fluid from the actuation fluid circuit to the master-slave circuit.

13. The device of claim 1 further comprising a pressure relief valve provided on a fluid line connected to the master-slave circuit.

14. The device of claim 13 wherein the pressure relief valve is configured to purge trapped air from the master-slave circuit through application of a pressure greater than a normal operating pressure.

15. A method of actuating a contamination cover on a machine bracket, the method comprising the steps of:

actuating a master cylinder positioned on the machine bracket, the master cylinder comprising a master cylinder barrel and a piston connected to a master piston rod;

driving a first slave cylinder positioned on the machine bracket, the first slave cylinder comprising a slave cylinder barrel and a piston connected to a slave piston rod, wherein the slave piston rod is connected to the contamination cover; and moving a volume of oil between the master cylinder and the first slave cylinder over fluid lines of a closed master-slave hydraulic circuit configured to connect a piston side chamber of the master cylinder to a piston side chamber of the first slave cylinder to transition the contamination cover between a closed position and an open position, wherein the slave piston rod is one of retracted into or extended from the slave cylinder barrel and the master piston rod is the other of retracted into or extended from the master cylinder barrel when the contamination cover is in an open position.

16. The method of claim 15 further comprising the step of permitting flow of fluid through an actuation fluid circuit by connecting a coupling switch to the actuation fluid circuit.

17. The method of claim 16 further comprising the step of permitting flow of fluid from the actuation fluid circuit to the master-slave circuit.

18. The method of claim 15 further comprising the step of permitting flow of fluid from an actuation fluid circuit to the master-slave circuit.

19. A coupling arrangement for fluid coupling a work tool to a machine, the coupling arrangement comprising:

at least one coupler assembly slideably mounted for coupling a machine fluid circuit and a work tool fluid circuit at a connect position;

an actuation fluid circuit arranged to actuate the at least one coupler assembly from a disconnect position to the connect position;

a contact switch configured to detect presence of the work tool for activation of the actuation fluid circuit; and a device configured to actuate a contamination cover on a machine bracket, the device comprising:

a master cylinder positioned on the machine bracket, the master cylinder comprising a master cylinder barrel and a piston connected to a master piston rod;

a first slave cylinder positioned on the machine bracket, the first slave cylinder comprising a slave cylinder barrel and a piston connected to a slave piston rod, wherein the slave piston rod is connected to the contamination cover; and a closed master-slave circuit connecting the master cylinder to the first slave cylinder wherein actuation of the master cylinder drives the slave cylinder for the transition of the contamination cover between a closed position and an open position, wherein the master-slave circuit comprises fluid lines configured to connect a piston side chamber of the master cylinder to a piston side chamber of the first slave cylinder and to move a volume of oil between the master cylinder and the first slave cylinder, and wherein the slave piston rod is one of retracted into or extended from the slave cylinder barrel and the master piston rod is the other of retracted into or extended from the master cylinder barrel when the contamination cover is in the open position.

20. A method of coupling a work tool to a machine, the method comprising:

providing at least one coupler assembly slideably mounted for coupling a machine fluid circuit and a work tool fluid circuit;

arranging an actuation fluid circuit to actuate the at least one coupler assembly from a disconnect position to a connect position;

arranging a contact switch to detect presence of the work tool; and activating the contact switch when the work tool is mounted to a machine bracket to permit pressurized fluid to flow to a device;

actuating a master cylinder positioned on the machine bracket of the device, the master cylinder comprising a master cylinder barrel and a piston connected to a master piston rod;

driving a first slave cylinder positioned on the machine bracket of the device, the first slave cylinder comprising a slave cylinder barrel and a piston connected to a slave piston rod, wherein the slave piston rod is connected to the contamination cover; and moving a volume of oil between the master cylinder and the first slave cylinder over fluid lines of a closed master-slave hydraulic circuit configured to connect a piston side chamber of the master cylinder to a piston side chamber of the first slave cylinder to transition the contamination cover between a closed position and an open position, wherein the slave piston rod is one of retracted into or extended from the slave cylinder barrel and the master piston rod is the other of retracted into or extended from the master cylinder barrel when the contamination cover is in an open position.

* * * * *